US011437201B2

(12) United States Patent
Hsieh et al.

(10) Patent No.: US 11,437,201 B2
(45) Date of Patent: Sep. 6, 2022

(54) KEY STRUCTURE

(71) Applicant: CHICONY ELECTRONICS CO., LTD., New Taipei (TW)

(72) Inventors: Chao-Chin Hsieh, New Taipei (TW); Wei-Yi Lin, New Taipei (TW)

(73) Assignee: CHICONY ELECTRONICS CO., LTD., New Taipei (TW)

( * ) Notice: Subject to any disclaimer, the term of this patent is extended or adjusted under 35 U.S.C. 154(b) by 0 days.

(21) Appl. No.: 17/143,550

(22) Filed: Jan. 7, 2021

(65) Prior Publication Data

US 2022/0068571 A1 Mar. 3, 2022

(30) Foreign Application Priority Data

Aug. 26, 2020 (TW) ..... 109129201

(51) Int. Cl.
*H01H 3/12* (2006.01)
*H01H 13/705* (2006.01)

(52) U.S. Cl.
CPC ..... *H01H 3/125* (2013.01); *H01H 13/705* (2013.01)

(58) Field of Classification Search
CPC .. H01H 3/125; H01H 13/705; H01H 13/7065; H01H 3/12; H01H 13/70; H01H 13/14
USPC ..... 200/341, 344, 345
See application file for complete search history.

(56) References Cited

U.S. PATENT DOCUMENTS 5,770,824 A * 6/1998 Tsai ..... H01H 3/125 200/344
6,366,275 B1 * 4/2002 Lai ..... H01H 3/125 200/344
9,946,359 B2 * 4/2018 Hou ..... G06F 3/0202

* cited by examiner

*Primary Examiner* — Lheiren Mae A Caroc
(74) *Attorney, Agent, or Firm* — Muncy, Geissler, Olds & Lowe P.C.

(57) ABSTRACT

A key structure includes a keycap and a connecting member. The keycap has a bottom surface and includes a fixing portion and an elastic arm. The fixing portion is disposed on the bottom surface, and the fixing portion has a connection hole and a first opening communicating with each other. At least one end of the elastic arm connects to a side surface of the fixing portion, and the elastic arm is adjacent to the first opening. The elastic arm has an open end communicating with the opening and a limiting surface toward the bottom surface. The connecting member includes a connection pin, one end of which connects to the connection hole and the other end of which has an extension portion. The connection pin is disposed in the connection hole, and the extension portion is disposed between the bottom surface and the limiting surface.

13 Claims, 8 Drawing Sheets

KEY STRUCTURE

BACKGROUND

1. Technical Field

The present disclosure relates to a key structure.

2. Description of the Related Art

The keyboard is an indispensable input device for current computer operations. Generally, the keyboard mainly comprises keycaps, connecting members, elastic members and a base plate. The common types of connecting member include a scissors-type connecting member, the two ends of which connect to the keycap and the base plate respectively. The elastic member is disposed in the internal space formed by the connecting member to provide an elastic force for returning the keycap to its original position.

The keycap and the connecting member are usually connected by a pivot hole and a connection pin. Specifically, a bottom surface of the conventional keycap has a drop-shaped pivot hole; that is, the inner diameter at the opening of the pivot hole is smaller than its central position. Correspondingly, the scissors-type connecting member has a connection pin. After the connection pin is disposed in the pivot hole, the connection pin is limited within the pivot hole because the inner diameter at the opening of the pivot hole is smaller.

However, the user only needs to exert a little force on the keycap and pull the keycap upward, and the connection pin can be removed from the pivot hole, causing the keycap to fall off. For some keyboards used for display products or public use, it is quite inconvenient that the keycaps can easily fall off or be removed. There is a need for improvement.

SUMMARY

In view of the above problems, the main object of the present invention is to provide a key structure wherein a novel structure comprising an elastic arm of a keycap and a connection pin of a connecting member solves the problem of the conventional keycap easily falling off.

In order to achieve the above object, the present disclosure provides a key structure, which includes a keycap and a connecting member. The keycap has a bottom surface, and the keycap comprises a fixing portion and an elastic arm. The fixing portion is disposed on the bottom surface. The fixing portion has a connection hole and a first opening, and the first opening communicates with the connection hole. At least one end of the elastic arm connects to a side of the fixing portion and is adjacent to the first opening. The elastic arm has an open end and a limiting surface. The open end communicates with the first opening, and the limiting surface is toward the bottom surface of the keycap. The connecting member comprises a connection pin. One end of the connection pin connects to the connecting member, and the other end has an extension portion. The connection pin passes through the first opening and is disposed in the connection hole, and the extension portion passes through the elastic arm and is disposed between the bottom surface of the keycap and the limiting surface.

In an embodiment of the present invention, the elastic arm comprises a closed end opposite to the open end.

In an embodiment of the present invention, the elastic arm has two side arms parallel to each other, and a second opening is formed between the two side arms and the closed end.

In an embodiment of the present invention, the two ends of the elastic arm connect to the fixing portion.

In an embodiment of the present invention, the extension portion has a flat-topped surface corresponding to the limiting surface of the elastic arm.

In an embodiment of the present invention, the limiting surface is a planar structure.

In an embodiment of the present invention, the extension portion has an arc-shaped bottom. The arc-shaped bottom of the extension portion passes through the elastic arm and is close to the bottom surface of the keycap.

In an embodiment of the present invention, the elastic arm has a guiding portion opposite to the limiting surface. The guiding portion guides the extension portion to pass through the elastic arm and is close to the bottom surface of the keycap.

In an embodiment of the present invention, the extension portion has a wedge-shaped bottom. The wedge-shaped bottom passes through the elastic arm and is close to the bottom surface of the keycap.

In an embodiment of the present invention, the width of the elastic arm at the open end is less than or equal to the width of the first opening of the fixing portion.

In an embodiment of the present invention, the elastic arm is substantially parallel to the bottom surface of the keycap.

In an embodiment of the present invention, there is a space between the extension portion and the limiting surface of the elastic arm.

In an embodiment of the present invention, the thickness of the extension portion is less than the thickness of the connection pin.

As described above, the key structure of the present invention comprises a keycap and a connecting member. The keycap comprises a fixing portion and an elastic arm. The fixing portion is disposed on the bottom surface of the keycap and has a connection hole. At least one end of the elastic arm connects to the fixing portion, and the elastic arm has a limiting surface toward the bottom surface of the keycap. The connecting member comprises a connection pin. One end of the connection pin connects to the connecting member, and the other end has an extension portion. When the connection pin is disposed in the connection hole, the extension portion passes through the elastic arm and is close to the bottom surface of the keycap. If the keycap is pulled up, the extension portion is limited by the elastic arm and the bottom surface of the keycap by the limiting surface of the elastic arm pressing against the extension portion to prevent the keycap from falling off.

BRIEF DESCRIPTION OF THE DRAWINGS

In the drawings, wherein similar reference numerals denote similar elements throughout the several views.

DETAILED DESCRIPTION OF THE EMBODIMENTS

In order to make the structure and characteristics as well as the effectiveness of the present invention to be further understood and recognized, detailed description of the present invention is provided as follows along with embodiments and accompanying figures.

Figure 1:
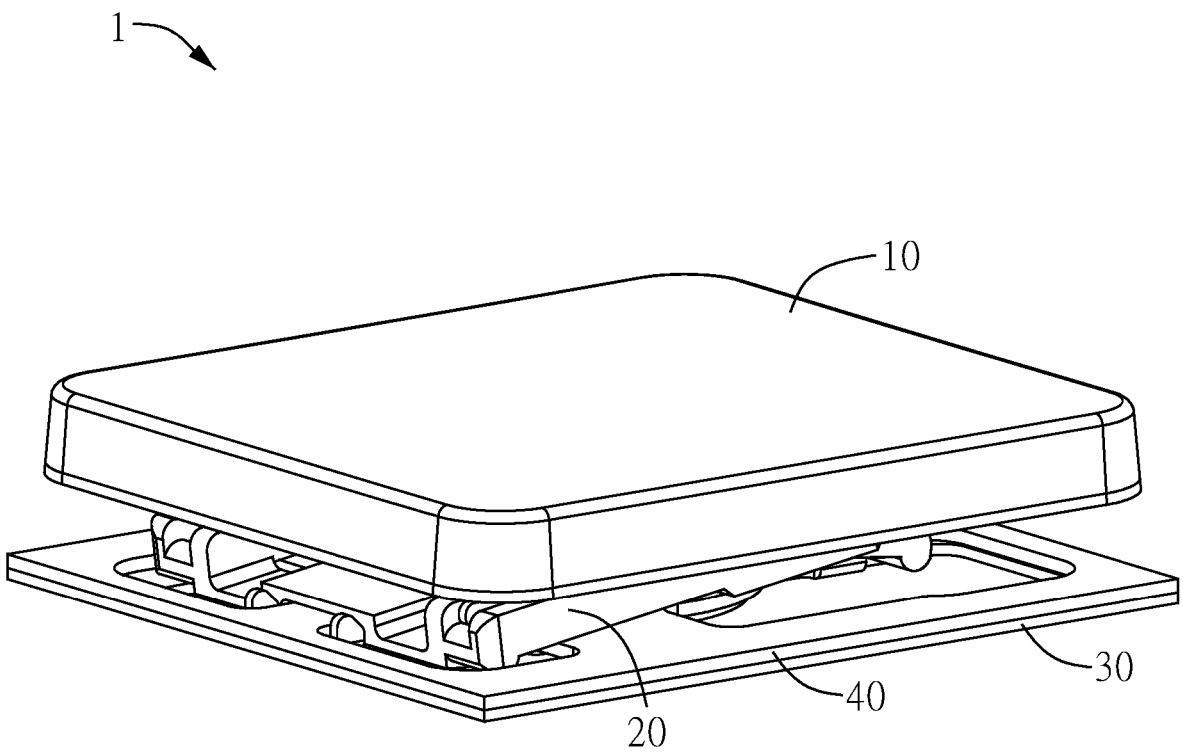
FIG. 1 illustrates a schematic view of a key structure according to a first embodiment of the present invention.
Figure 2:
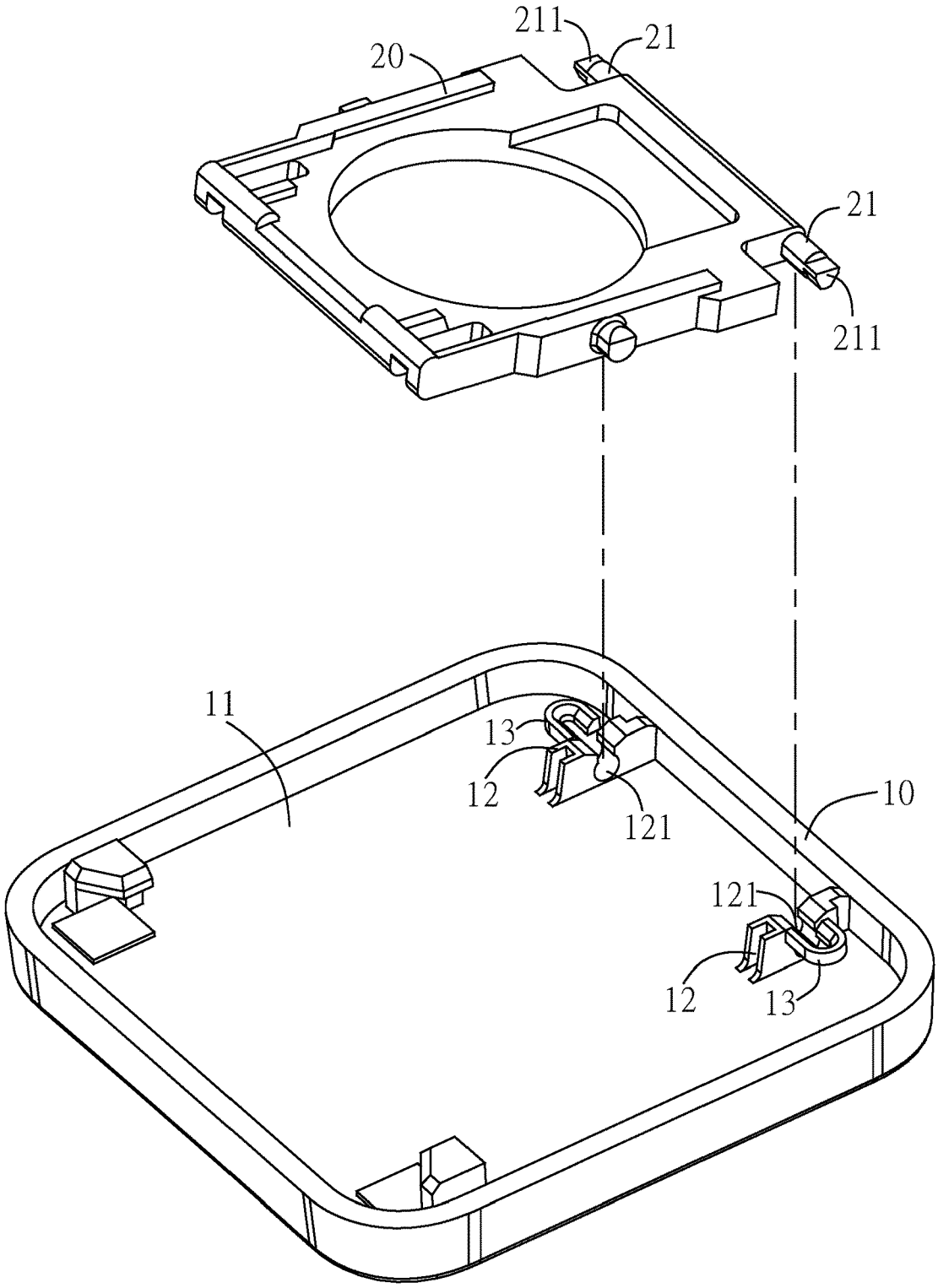
FIG. 2 illustrates an exploded view of a keycap and a connecting member shown in FIG. 1.

Please refer to FIG. 1 and FIG. 2, where FIG. 1 illustrates a schematic view of a key structure according to a first embodiment of the present invention and FIG. 2 illustrates an exploded view of a keycap and a connecting member shown in FIG. 1. In this embodiment, the key structure 1 comprises a keycap 10, a connecting member 20, a base plate 30, a circuit board 40 and an elastic member (not shown in figures). The circuit board 40 is disposed on the upper surface of the base plate 30, and the circuit board 40 has a plurality of openings corresponding to the structure of the base plate 30 such that one end of the connecting member 20 can be assembled with the base plate 30. The other end of the connecting member 20 connects to the keycap 10. The keycap 10 is connected to the base plate 30 by the connecting member 20 and moves up and down relative to the base plate 30, guided by the connecting member 20, as shown in FIG. 2. The connecting member 20 of this embodiment is a scissors-type connecting assembly, but the present disclosure is not limited thereto, for the connecting member 20 can also be a butterfly-type connecting assembly or other link bar assembly. The elastic member is disposed between the keycap 10 and the circuit board 40, and the elastic member is located in the scissors-type connecting member. When the keycap 10 is pressed, the elastic member triggers the switch of the circuit board 40 to generate a signal and restores the keycap 10 to its original position, which is its position prior to being pressed. It should be noted that, for the sake of drawing simplicity, FIG. 2 shows only one connecting member 20 of the scissor connection assembly.

Figure 3A:
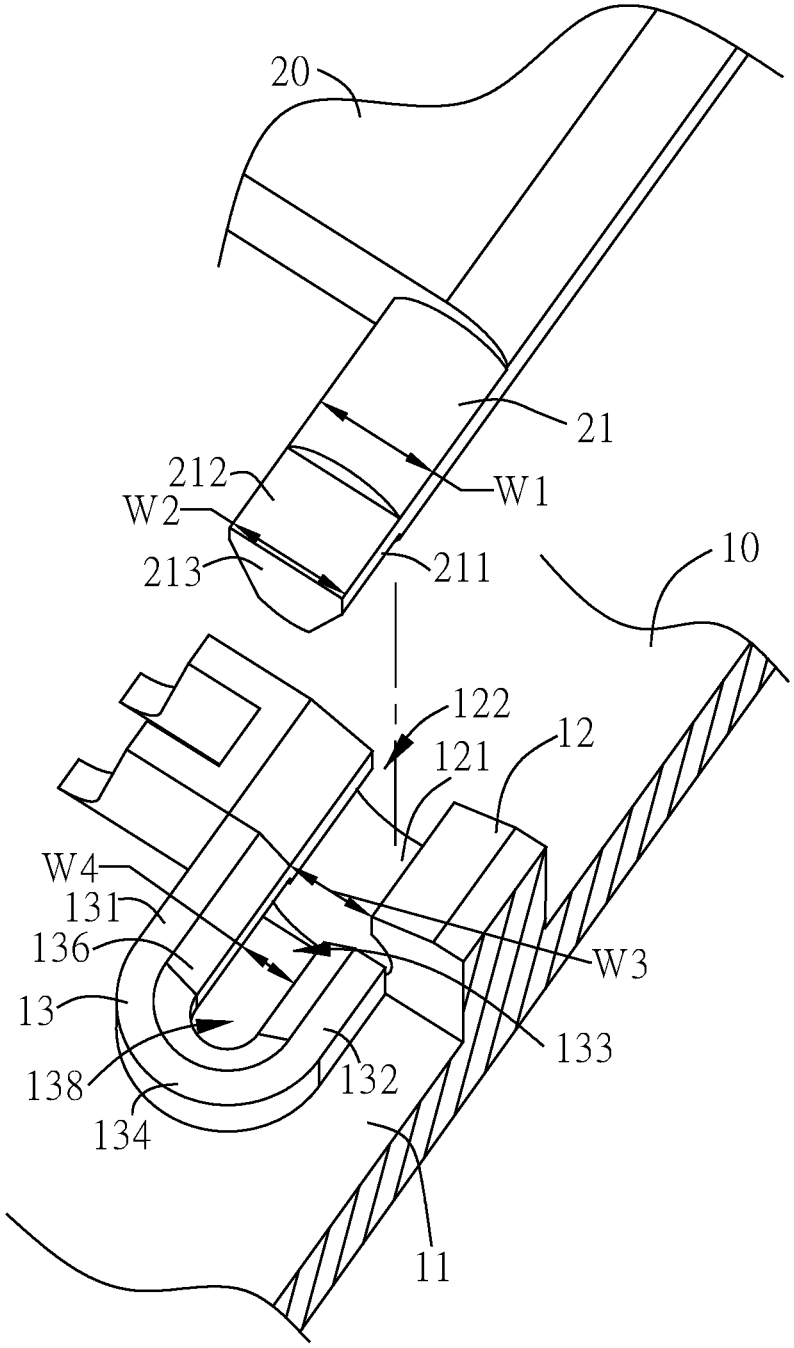
FIG. 3A illustrates a partially enlarged view of the keycap and the connecting member shown in FIG. 2.
Figure 3B:
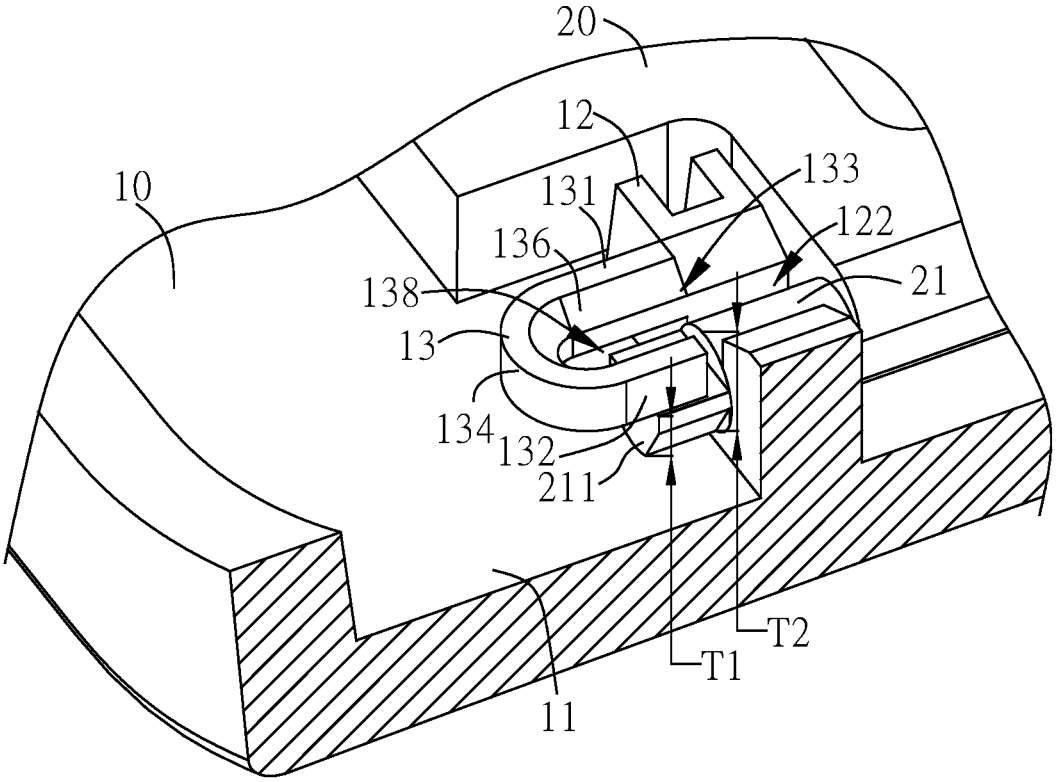
FIG. 3B illustrates a schematic view of the keycap and the connecting member shown in FIG. 3A after assembly.
Figure 3C:
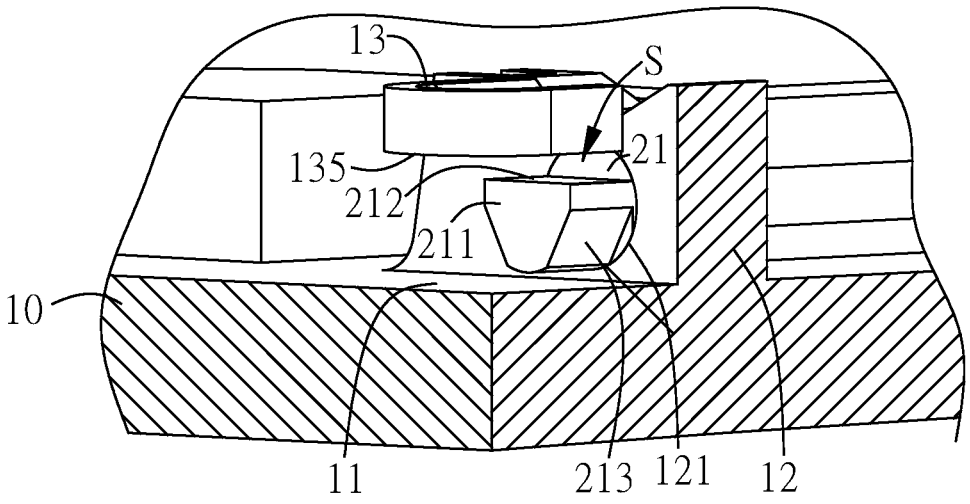
FIG. 3C illustrates a left view of the keycap and the connecting member shown in FIG. 3B.

In this embodiment, the keycap 10 has a bottom surface 11 with a structure for connecting with the connecting member 20. Please refer to FIG. 2, FIG. 3A, FIG. 3B and FIG. 3C. FIG. 3A illustrates a partially enlarged view of the keycap and the connecting member shown in FIG. 2; FIG. 3B illustrates a schematic view of the keycap and the connecting member shown in FIG. 3A after assembly; FIG. 3C illustrates a left view of the keycap and the connecting member shown in FIG. 3B. The keycap 10 comprises a fixing portion 12 and an elastic arm 13. The fixing portion 12 is disposed on the bottom surface 11, and in this embodiment, one side of the fixing portion 12 is directly disposed on the bottom surface 11. The fixing portion 12 has a connection hole 121, and the connection hole 121 is a through hole passing through the fixing portion 12. Further, the fixing portion 12 has a first opening 122 disposed on the side opposite to the bottom surface 11, and the first opening 122 communicates with the connection hole 121. In other words, the connection hole 121 is not a closed through hole; one end opposite to the bottom surface 11 is an open end (the first opening 122) for assembly with the connecting member 20. In this embodiment, the connection hole 121 is a circular through hole, and the diameter of the connection hole 121 is greater than the width of the first opening 122.

At least one end of the elastic arm 13 connects to a side of the fixing portion 12. Preferably, the elastic arm 13 is parallel to the bottom surface 11 of the keycap 10. Moreover, the elastic arm 13 is adjacent to the first opening 122 such that there is a space between the elastic arm 13 and the bottom surface 11 to accommodate a portion of the connecting member 20. In this embodiment, the elastic arm 13 is a U-shaped structure, which has two parallel side arms 131, 132, an open end 133 and a closed end 134, and the closed end 134 is opposite to the open end 133. Furthermore, a second opening 138 is formed between the two side arms 131, 132 and the closed end 134. Specifically, one end of the side arm 131 connects to the fixing portion 12 such that the open end 133 is close to and communicates with the first opening 122 of the fixing portion 12. In other words, the second opening 138 and the first opening 122 communicate with each other. In addition, the elastic arm 13 has a limiting surface 135 (as shown in FIG. 3C), which is a side surface toward to the bottom surface 11 of the keycap 10. In other words, the limiting surface 135 faces the bottom surface 11 of the keycap 10.

The connecting member 20 comprises a plurality of connection pins 21. One end of a connection pin 21 connects to the connecting member 20, and the other end has an extension portion 211. In this embodiment, four corners of the connecting member 20 protrude outward to form the connection pins 21, and each of the connection pins 21 extends outward to form the extension portion 211. In this embodiment, the width W1 of the connection pin 21 is equal to the width W2 of the extension portion 211, the width W1 of the connection pin 21 is greater than the width W3 the first opening 122, and the width W2 of the extension portion 211 is greater than the width W4 of the second opening 138. During assembly of the keycap 10 to the connecting member 20, the connection pin 21 is able to spread and pass through the first opening 122 to be inserted into the connection hole 121; that is, the connection pin 21 is disposed in the connection hole 121. Further, the connection pin 21 can be rotated in the connection hole 121. At the same time, the extension portion 211 is able to spread and pass through the elastic arm 13 and is close to the bottom surface 11 of the keycap 10 such that the extension portion 211 is disposed between the bottom surface 11 of the keycap 10 and the limiting surface 135 of the elastic arm 13, as shown in FIG. 3C, whereupon the assembly of the keycap 10 and the connecting member 20 is completed. Preferably, the thickness T1 of the extension portion 211 is less than the thickness T2 of the connection pin 21 (as shown in FIG. 3B) to reduce the space required between the limiting surface 135 of the elastic arm 13 and the bottom surface 11 of the keycap 10.

Please refer to FIG. 1. If the keycap 10 is pulled upward by force, then because the width W2 of the extension portion 211 is greater than the width W4 of the second opening 138, the extension portion 211 can be limited between the elastic arm 13 and the bottom surface 11 of the keycap 10 by the limiting surface 135 of the elastic arm 13 pressing against the extension portion 211 to prevent the keycap 10 from being removed. Preferably, the limiting surface 135 is a planar structure. When the keycap 10 is pulled by force, the limiting surface 135 is able to press against the extension portion 211 effectively to prevent the extension portion 211 from sliding out of the elastic arm 13. Preferably, the extension portion 211 has a flat-topped surface 212 corresponding to the limiting surface 135 of the elastic arm 13. Because both flat-topped surface 212 and the limiting surface 135 are planar structures, then when the keycap 10 is pulled by force, the limiting surface 135 and the flat-topped surface 212 abuts each other to achieve a better effect of preventing the keycap 10 from falling off.

In this embodiment, there is a space S (as shown in FIG. 3C) between the extension portion 211 and the limiting surface 135 of the elastic arm 13. When the keycap 10 is pressed and moves up and down relative to the base plate 30 (refers to FIG. 1), the extension portion 211 can avoid contact with the elastic arm 13 because of the space S such that the keycap 10 can move up and down smoothly. In other words, the user will not feel that the key sticks when pressing the keycap 10.

Please refer to FIG. 3A, FIG. 3B and FIG. 3C. Preferably, the elastic arm 13 has a guiding portion 136 opposite to the limiting surface 135. In other words, a side of the elastic arm 13 toward the bottom surface 11 is the limiting surface 135, and the other side of the elastic arm 13 has the guiding portion 136. The guiding portion 136 is formed on an inner edge of the elastic arm 13 such that the extension portion 211 is guided by the guiding portion 136 and passes between the side arms 131, 132. In other words, the guiding portion 136 guides the extension portion 211 to pass through the elastic arm 13 and is close to the bottom surface 11 of the keycap 10. Preferably, the extension portion 211 of this embodiment has a wedge-shaped bottom 213, which is disposed on the opposite side of the flat-topped surface 212. That is, one side of the extension portion 211 is the flat-topped surface 212, and the other side is the wedge-shaped bottom 213. The wedge-shaped bottom 213 may be wedge-shaped or wedge-shaped with a flat tip as shown in FIG. 3B and FIG. 3C, as long as there is an inclined surface to cooperate with the guiding portion 136. Due to the inclined surface of the wedge-shaped bottom 213, the guiding portion 136 can more smoothly guide the wedge-shaped bottom 213 through the elastic arm 13 such that it is close to the bottom surface 11 of the keycap 10. In other embodiments, the extension portion 211 may also have other configurations.

Figure 4:
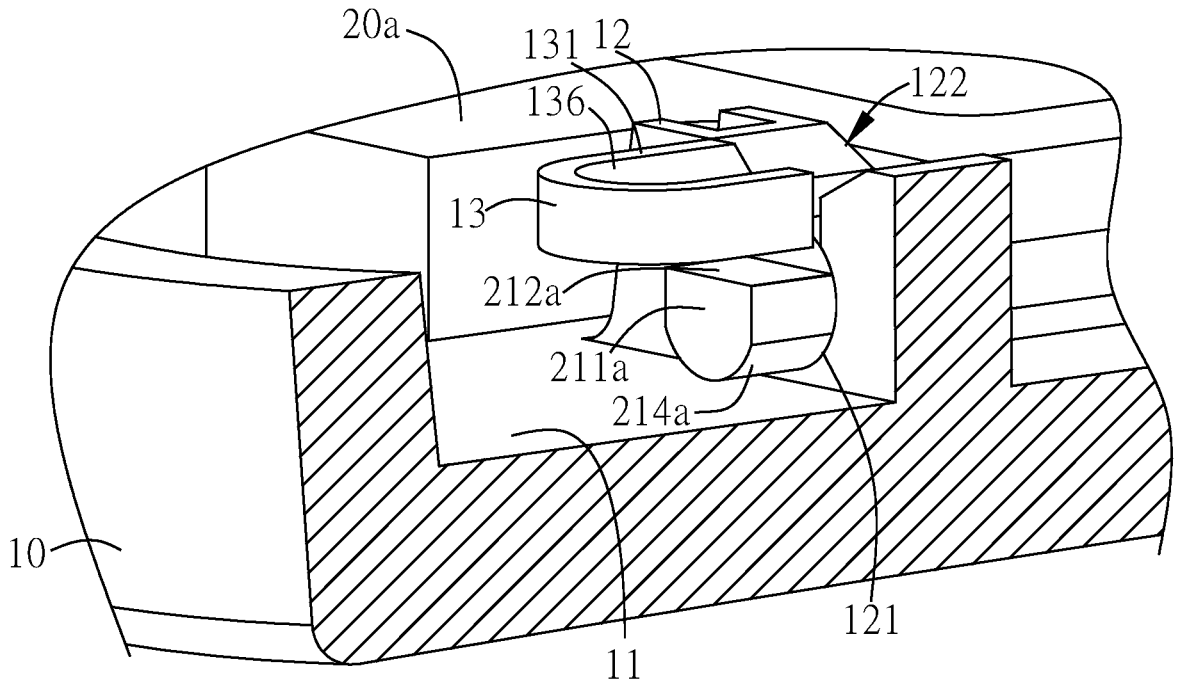
FIG. 4 illustrates a schematic view of a keycap and a connecting member according to a second embodiment of the present invention after assembly.

Please refer to FIG. 4, which illustrates a schematic view of a keycap 10 and a connecting member 20*a* according to a second embodiment of the present invention after assembly. The structure of the keycap 10 of the second embodiment is the same as that of the first embodiment, with the same reference numerals denoting the same elements. The difference between the second embodiment and the first embodiment is in the structure of the extension portion 211*a* of the connecting member 20*a*. In this embodiment, the extension portion 211*a* has an arc-shaped bottom 214*a*. That is, one side of the extension portion 211*a* is also a flat-topped surface 212*a*, and the other side is an arc-shaped bottom 214*a*. Due to the arc structure of the arc-shaped bottom 214*a*, the guiding portion 136 is able to guide the arc-shaped bottom 214*a* to pass through the elastic arm 13 such that it is close to the bottom surface 11 of the keycap 10. In other words, the arc-shaped bottom 214*a* of the extension portion 211*a* is able to pass through the elastic arm 13 such that it is close to the bottom surface 11 of the keycap 10.

Figure 5:
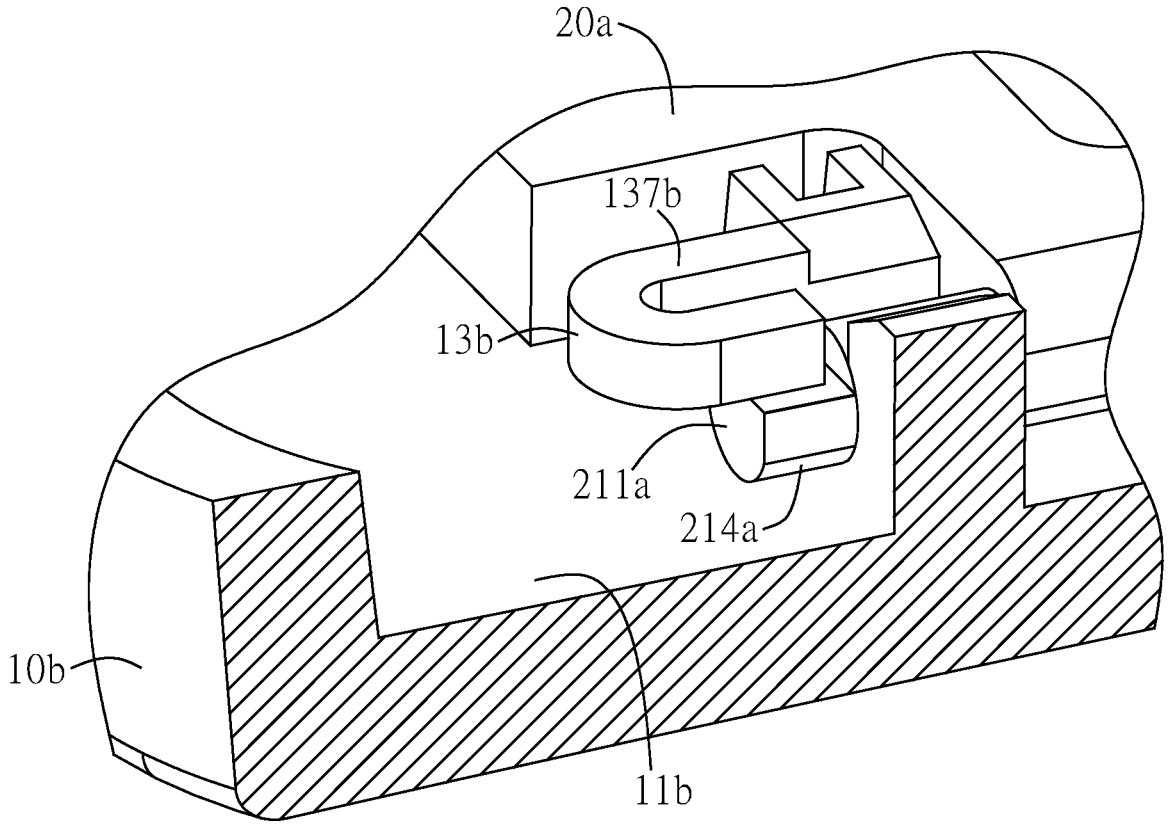
FIG. 5 illustrates a schematic view of a keycap and a connecting member according to a third embodiment of the present invention after assembly.

Please refer to FIG. 5, which illustrates a schematic view of a keycap 10*b* and a connecting member 20*a* according to a third embodiment of the present invention after assembly. The structure of the connecting member 20*a* of the third embodiment is the same as that of the second embodiment, with the same reference numerals denoting the same elements. The difference between the third embodiment and the second embodiment is in the structure of the elastic arm 13*b* of the keycap 10*b*. In this embodiment, the elastic arm 13*b* does not have the guiding portion 136 (as shown in FIG. 3 or FIG. 4); that is, the upper surface of the elastic arm 13*b* (i.e., the surface away from the bottom surface 11*b*) is a planar structure 137*b*. Specifically, the extension portion 211*a* of this embodiment has an arc-shaped bottom 214*a*, so the arc-shaped bottom 214*a* of the extension portion 211*a* can pass through the elastic arm 13*b* (whose upper surface is the planar structure 137*b*) such that it is close to the bottom surface 11*b* of the keycap 10*b*.

In the aforesaid first, second and third embodiments (herein taking the first embodiment as an example; please refer to FIG. 3A and FIG. 3B), the width W4 of the elastic arm 13 at the open end 133 is less than or equal to the width W3 of the first opening 122 of the connection hole 121. It should be noted that the width (W4) at the open end 133 is equal to the width between the two parallel side arms 131, 132 of the elastic arm 13, and is also equal to the width (W4) of the second opening 138.

In the first, second and third embodiments, one end of the elastic arm 13 (the U-shaped structure) connects to the side of the fixing portion 12, and the other end is close to the fixing portion 12 but not connected to it. For example, one end of the side arm 131 connects to the side of the fixing portion 12, and the side arm 132 does not connect to the fixing portion 12. The elastic arm 13 has the flexibility to expand outward because the side arm 132 does not connect to the fixing portion 12. Even though the width W2 of the extension portion 211 is slightly greater than the width W4 of the open end 133, the side arm 132 does not connect to the fixing portion 12 and can be slightly expanded. Therefore, the extension portion 211 can still pass through the elastic arm 13 such that it is close to the bottom surface 11 of the keycap 10. Moreover, because the side arm 132 does not connect to the fixing portion 12, preferably, the width W4 of the open end 133 is less than the width W3 of the first opening 122 to prevent the extension portion 211 from easily passing through or passing out of the elastic arm 13.

Figure 6A:
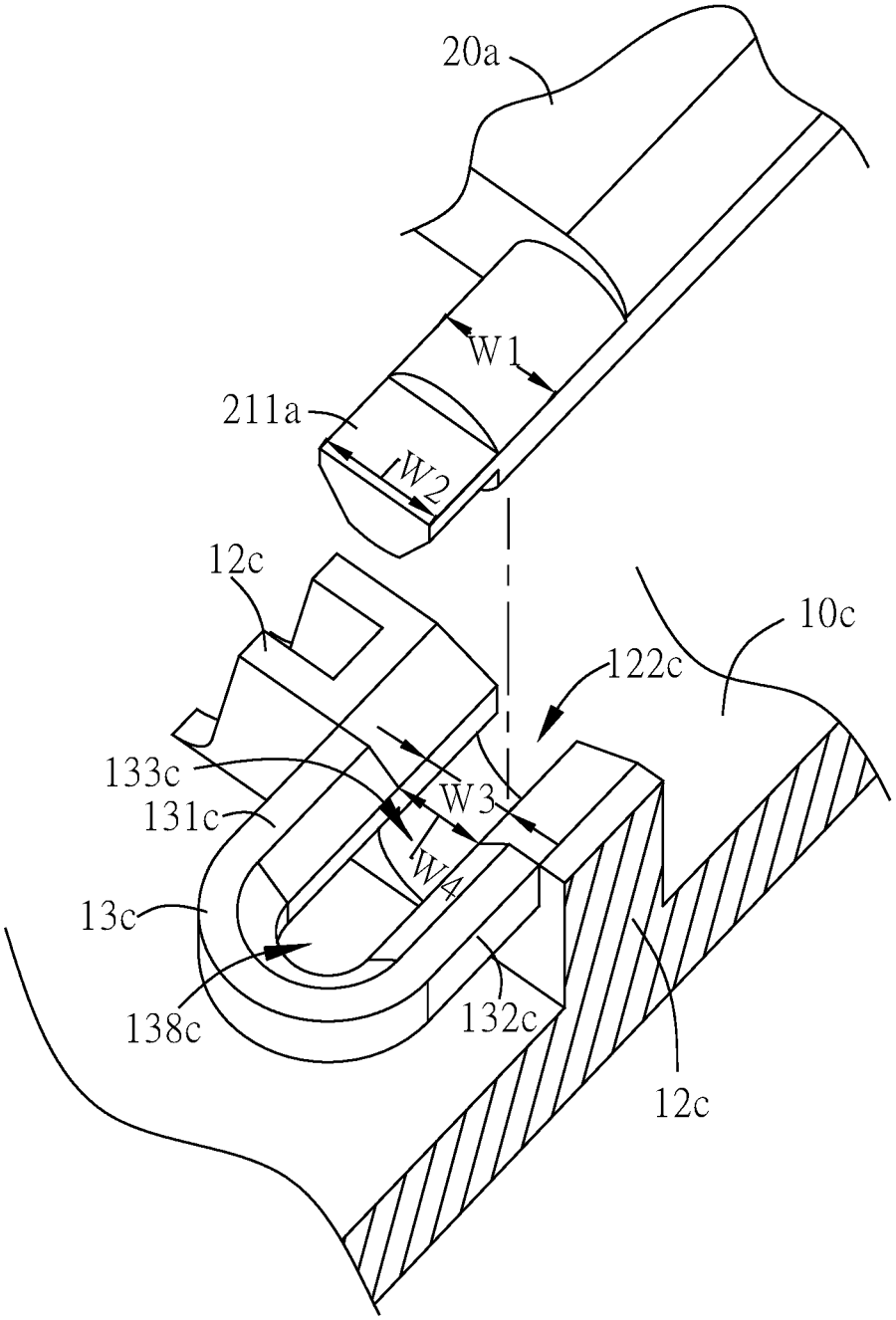
FIG. 6A illustrates an exploded view of a keycap and a connecting member according to a fourth embodiment of the present invention.
Figure 6B:
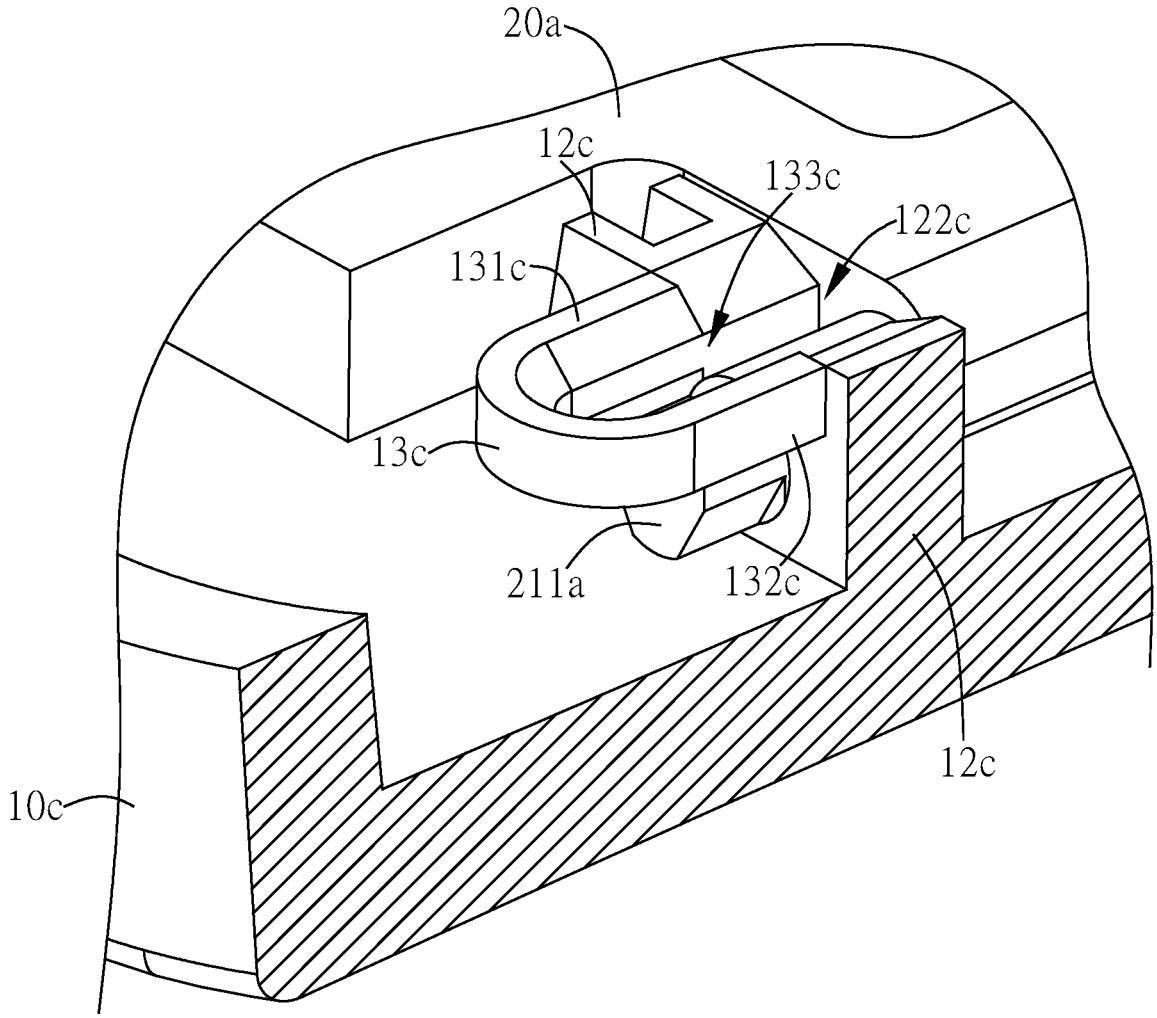
FIG. 6B illustrates a schematic view of the keycap and the connecting member according to the fourth embodiment of the present invention after assembly.

Please refer to FIG. 6A and FIG. 6B, where FIG. 6A illustrates an exploded view of a keycap and a connecting member according to a fourth embodiment of the present invention, and FIG. 6B illustrates a schematic view of the keycap and the connecting member according to the fourth embodiment of the present invention after assembly. The structure of the connecting member 20*a* of the fourth embodiment is the same as that of the second embodiment, with the same reference numerals denoting the same elements. The difference between the fourth embodiment and the second embodiment is in the connection of the elastic arm 13*c*; that is, the two ends of the elastic arm 13*c* connect to the fixing portion 12*c*. In other words, the side arms 131*c*, 132*c* both connect to the fixing portion 12*c*. The width W4 of the open end 133*c* is substantially equal to the width W3 of the first opening 122*c*. In this embodiment, the width W4 of the open end 133*c* is equal to the width W3 of the first opening 122*c* (as shown in FIG. 6A and FIG. 6B). Because the structure of the two ends of the elastic arm 13*c* is connected to the fixing portion 12*c*, then even though the width W4 of the open end 133*c* is equal to the width W3 of the first opening 122*c*, the extension portion 211*a* can be prevented from easily passing through or passing out of the elastic arm 13*c*.

As described above, the key structure of the present invention comprises a keycap and a connecting member. The keycap comprises a fixing portion and an elastic arm. The fixing portion is disposed on the bottom surface of the keycap and has a connection hole. At least one end of the elastic arm connects to the fixing portion, and the elastic arm has a limiting surface toward the bottom surface of the keycap. The connecting member comprises a connection pin, one end of the connection pin connects to the connecting member, and the other end has an extension portion. When the connection pin is disposed in the connection hole, the extension portion passes through the elastic arm and is close to the bottom surface of the keycap. If the keycap is pulled up, the extension portion can be limited between the elastic arm and the bottom surface of the keycap by the limiting surface of the elastic arm pressing against the extension portion to prevent the keycap from falling off.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the appended claims.

What is claimed is:

1. A key structure, comprising:

a keycap having a bottom surface, the keycap comprising:

a fixing portion disposed on the bottom surface, the fixing portion having a connection hole and a first opening, the first opening communicating with the connection hole; and an elastic arm, at least one end of which connects to a side of the fixing portion and is adjacent to the first opening, the elastic arm having an open end communicating with the first opening and a limiting surface toward the bottom surface of the keycap; and a connecting member comprising a connection pin, one end of which connects to the connecting member and the other end of which has an extension portion, wherein the connection pin passes through the first opening and is disposed in the connection hole, and the extension portion passes through the elastic arm and is disposed between the bottom surface of the keycap and the limiting surface, wherein there is a space between the extension portion and the limiting surface of the elastic arm.

2. The key structure as claimed in claim 1, wherein the elastic arm comprises a closed end opposite to the open end.

3. The key structure as claimed in claim 2, wherein the elastic arm is a U-shaped structure.

4. The key structure as claimed in claim 2, wherein the elastic arm has two side arms parallel to each other, and a second opening is formed between the two side arms and the closed end.

5. The key structure as claimed in claim 1, wherein two ends of the elastic arm connect to the fixing portion.

6. The key structure as claimed in claim 1, wherein the extension portion has a flat-topped surface corresponding to the limiting surface of the elastic arm.

7. The key structure as claimed in claim 1, wherein the limiting surface is a planar structure.

8. The key structure as claimed in claim 1, wherein the extension portion has an arc-shaped bottom, and the arc-shaped bottom of the extension portion passes through the elastic arm and is close to the bottom surface of the keycap.

9. The key structure as claimed in claim 1, wherein the elastic arm has a guiding portion opposite to the limiting surface, and the guiding portion guides the extension portion to pass through the elastic arm and is close to the bottom surface of the keycap.

10. The key structure as claimed in claim 1, wherein the extension portion has a wedge-shaped bottom, and the wedge-shaped bottom passes through the elastic arm and is close to the bottom surface of the keycap.

11. The key structure as claimed in claim 1, wherein a width of the elastic arm at the open end is less than or equal to a width of the first opening of the fixing portion.

12. The key structure as claimed in claim 1, wherein the elastic arm is substantially parallel to the bottom surface of the keycap.

13. The key structure as claimed in claim 1, wherein a thickness of the extension portion is less than a thickness of the connection pin.

* * * * *